United States Patent [19]

Sutcliffe et al.

[11] Patent Number: 4,905,443

[45] Date of Patent: Mar. 6, 1990

[54] NODE MEMBER FOR USE IN BUILDING A GEODESIC STRUCTURE

[76] Inventors: Desmond R. R. Sutcliffe, 21 Towngate, Heptonstall, Hebden Bridge, West Yorkshire HX7 7LW; Keith Critchlow, 2 Larkhall Lane, London, SW4 6SP; Philip J. Gray, Roberts Weaver, 7 Westbourne Grove Mews, London W11 2SA, all of England

[21] Appl. No.: 149,461

[22] Filed: Jan. 28, 1988

[30] Foreign Application Priority Data

Feb. 2, 1987 [GB] United Kingdom ..... 8702279

[51] Int. Cl.[4] ..... E04H 12/06

[52] U.S. Cl. ..... 52/648; 403/171; 403/176; 52/646

[58] Field of Search ..... 52/81, 645, 646, 648, 52/726; 403/171–176; 16/2; 174/152 G; 411/904, 907, 908

[56] References Cited

U.S. PATENT DOCUMENTS

| | | | |
|---|---|---|---|
| 1,218,216 | 3/1917 | Schmid | 16/2 |
| 2,308,965 | 1/1943 | Riesing | 16/2 |
| 2,965,349 | 12/1960 | Hutton | 403/171 |
| 3,061,888 | 11/1962 | Wadham | 411/908 |
| 3,679,249 | 7/1972 | Hoffman | 403/69 |
| 3,789,562 | 2/1974 | Chiccis et al. | 52/81 |
| 4,763,459 | 8/1988 | Wesselski | 52/646 |
| 4,766,712 | 8/1988 | Hale | 52/645 |

FOREIGN PATENT DOCUMENTS

| | | | |
|---|---|---|---|
| 55868 | 6/1966 | Fed. Rep. of Germany . | |
| 3031551 | 8/1980 | Fed. Rep. of Germany . | |
| 1219923 | 12/1959 | France | 403/173 |
| 2250395 | 11/1973 | France . | |
| 604753 | 3/1974 | Switzerland . | |
| 754050 | 8/1956 | United Kingdom . | |
| 755584 | 8/1956 | United Kingdom . | |
| 1086885 | 11/1967 | United Kingdom . | |
| 1496196 | 12/1977 | United Kingdom . | |
| 2034186 | 6/1980 | United Kingdom . | |
| 2133496 | 7/1984 | United Kingdom . | |
| 2175367 | 4/1985 | United Kingdom . | |
| 2158544 | 11/1985 | United Kingdom . | |

*Primary Examiner*—James L. Ridgill, Jr.
*Attorney, Agent, or Firm*—Silverman, Cass & Singer, Ltd.

[57] ABSTRACT

A node member (1) for use in building a geodesic structure having a multiplicity of connecting means (10) about its periphery for connection to other like node members (1) by connecting members (17) to form the geodesic structure, has connecting means (10) that are resiliently movable to permit relative angular displacement of connecting members (17) connected to them.

20 Claims, 4 Drawing Sheets

NODE MEMBER FOR USE IN BUILDING A GEODESIC STRUCTURE

This invention relates to a node member for use in building a geodesic structure.

The present invention provides a node member for use in building a geodesic structure, the node member having a multiplicity of connecting means about its periphery for connection to other like node members by connecting members to form the geodesic structure, characterized in that the connecting means are resiliently movable to permit relative angular displacement of connecting members connected to them.

The mounting means may be movable in the sense of being displaceable or movable in the sense of being deformable.

Where the connecting means are strong enough, in use, to support the weight of a child, such a node member is of particular value in building a climbing frame for use in a children's playground. The resiliently movable mounting means enable the climbing frame to move and flex as children climb about on it and thus the frame is a much more exciting structure for their play than the substantially rigid frames often found in children's playgrounds. Moreover, such a climbing frame is safer than the known "adventure-type" playground structures which are more suited for use by older children. A node in accordance with the invention may be also be used in the building construction industry to accommodate tolerances when mounting components not necessarily forming part of a geodesic structure.

Preferably, the node member comprises a node member body of substantially rigid material in which connecting means of resilient polymeric material are mounted. This is a particularly simple way of enabling angular displacement of the connecting members.

Preferably, the node member body of substantially rigid material is made of metal.

Preferably, the node member body is hollow. By this means, the structure is rendered lighter and manufacture can be simplified.

Preferably, the node member body is substantially spherical. By this means, a simple and aesthetically pleasing structure is obtained.

Preferably, the diameter of the node member body is in excess of 100 millimeters, more preferably in excess of 125 millimeters, yet more preferably, in excess of 150 millimeters, and still more preferably, in the range 170 to 180 millimeters. Giving the node member body a large diameter facilitates the provision of many positions for locating connecting means whilst allowing sufficient strength to be maintained.

Advantageously, the node member body is made of two substantially identical halves joined to each other. By this means, tooling costs can be reduced and manufacture facilitated.

Advantageously, the two halves overlap each other at the join. By this means a particularly strong construction can be achieved, particularly when the two halves are of metal and secured to each other by welding.

Advantageously, the hollow node member body has a multiplicity of apertures in its surface in which the connecting means fit. Such a construction is particularly simple to manufacture.

Preferably, one or more plugs are provided, each to blank off an aperture not required for use. By this means, it is possible to provide many apertures in the node member body and yet obtain an aesthetically satisfactory appearance in use.

Preferably, the or each of the one or more plugs is of resilient polymeric material and is provided with a retaining flange to engage the edge of an aperture.

Advantageously, the connecting means are grommets of resilient polymeric material. This is a particularly simple way of permitting angular displacement of the connecting members.

Preferably, the apertures are circular and the grommets each have an annular body portion with an annular peripheral groove to engage the edge of an aperture.

Advantageously, each grommet has an extension portion projecting outwardly, in use, from the node member body and including a metal sleeve, bonded to the material of the grommet, to which a connecting member can be secured.

Preferably, a bore to receive a nut and bolt fixing for retaining a connecting member is provided and runs transverse to the longitudinal axis of the sleeve through the extension portion and the sleeve.

The invention also provides a node member as defined above in combination with one or more connecting members connectible to the connecting means.

Advantageously, the or each connecting member has a circular cylindrical end portion arranged to fit within the annular body portion and prevent removal of the grommet from the associated aperture in the node member body. This method of retaining the grommet in position is particularly simple.

Preferably, the or each end portion has a pair of aligned apertures to receive the nut and bolt fixing.

Preferably, one or more connecting members of tubular form are provided. Such members are relatively strong and light and easy to make.

Advantageously, one or more connecting members of plate-like form with tubular connecting portions are provided. Where the invention is used in a children's climbing frame, this feature enables a platform for one or more children to stand on to be provided in the frame.

One or more of the connecting members of plate-like form may be substantially triangular in plan.

In another form of construction, the node member comprises a node member body of resilient polymeric material in which metal connecting means are embedded.

Advantageously, the metal connecting means are screw-threaded.

The invention also provides a geodesic structure made up of a plurality of parts as defined above.

The invention also provides the use of a geodesic structure as defined above as an item of equipment in a children's playground.

Node members constructed in accordance with the invention will now be described, by way of example only, with reference to the accompanying drawings, in which.

Figure 1:
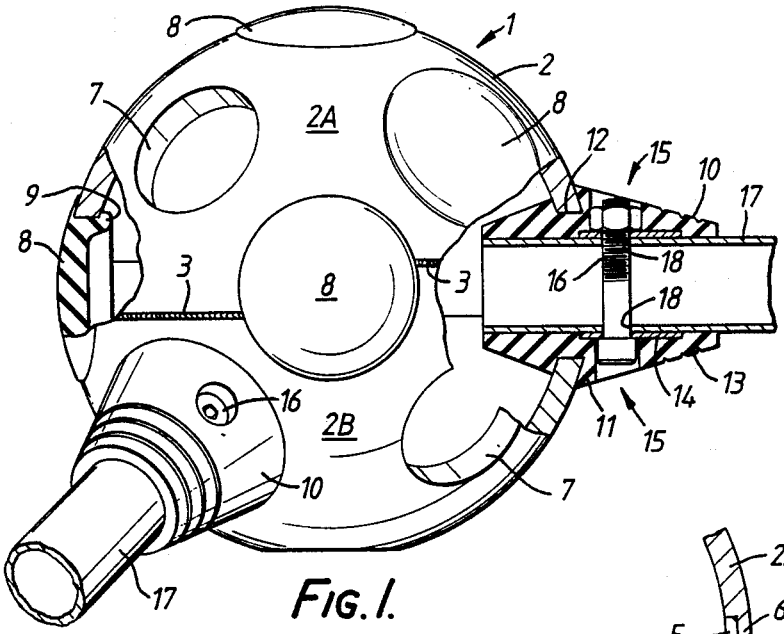
FIG. 1 is a diagrammatic perspective view partly in section of a node member and connecting members.
Figure 1A:
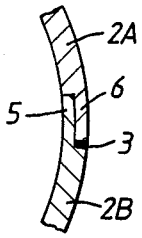
FIG. 1A is a sectional view showing a detail of the construction of the node member of FIG. 1.

Referring to the drawings, a node member 1 for use in building a geodesic structure comprises a hollow spherical aluminium body 2 of 175 millimeters outside diameter and 8 millimetre wall thickness. The body 2 is made of two identical cast halves 2A and 2B joined to each other by welding at 3. The two halves overlap at the join as shown in FIG. 1A, the overlap being made possible by having an inner tongue 5 on one side of each half and an outer tongue 6 on the other side.

The body 2 is provided with fourteen like apertures 7 corresponding to various orientations of connecting members in a geodesic structure. If the body 2 is likened to the Earth, then there is a respective aperture at each of the North and South poles, four at 90° intervals on the equator, and four above and four below the equator equally-spaced on a latitude of 45°. It is not, however, essential that this number of apertures should be provided or that they should have the orientations just described. Those apertures 7 which are not required in a particular geodesic structure are blanked off by means of resilient rubber plugs 8 pushed into the apertures and held in place by a retaining flange 9 on each plug.

Connecting means 10 are fitted to those apertures 7 which are to be utilised in the geodesic structure. Each connecting means 10 is made of resilient rubber material and comprises a grommet having an annular body portion 11 with an annular peripheral groove 12 to engage the edge of an aperture 7, and an extension portion 13 including a metal sleeve 14 bonded to the material of the grommet. A bore 15 to receive a nut and bolt fixing 16 for a connecting member 17 is provided and runs transverse to the longitudinal axis of the sleeve 14 through the extension portion 13 and the sleeve.

The connecting members 17 are metal tubes provided at each end with a pair of aligned apertures 18 to receive the fixing 16 which, preferably and as shown, comprises a hexagonal-headed bolt and a cap nut with a pentagonal socket in its end.

In building a geodesic structure from the components just described, a connecting means 10 is pushed into a selected aperture 7 until the edge of the aperture engages in the groove 12, the end of a connecting member 17 is then pushed into the connecting means until the apertures 18 align with the bore 15 and the two parts of the fixing 16 are applied and screwed together. The positioning of the apertures 18 is such that the end of the connecting member 17 coincides with the inner end of the connecting means 10 and because the connecting member is a push fit within the annular body 11, the connecting means cannot now escape from the aperture 7 even when the parts are built with other like node members and connecting members into a climbing frame and have to support the weight of a child. The resilient nature of the connecting means 10 makes the connecting means movable and so permits relative angular displacement of the connecting means 17. This feature enables a climbing frame constructed from the illustrated parts to flex resiliently when one or more children climb upon it. The children may thus experience a sensation somewhat akin to climbing a tree rather than the "dead" experience of climbing the ordinary static kind of climbing frame.

Figure 2:
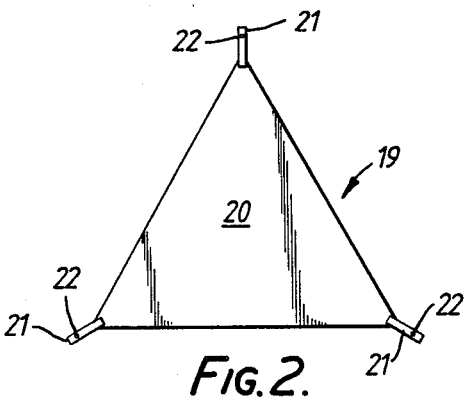
FIG. 2 shows another form of connecting member.

FIG. 2 shows a different form of connecting member 19 which takes the form of a metal plate 20 large enough for one or more children to stand on and having tubular members 21 with apertures 22 to insert into the connecting means 10 in the same manner as the connecting members 17. A group of children on the platform would be able to act together to make the climbing frame incorporating the platform flex back and forth, so adding to their enjoyment of the climbing frame.

Figure 3:
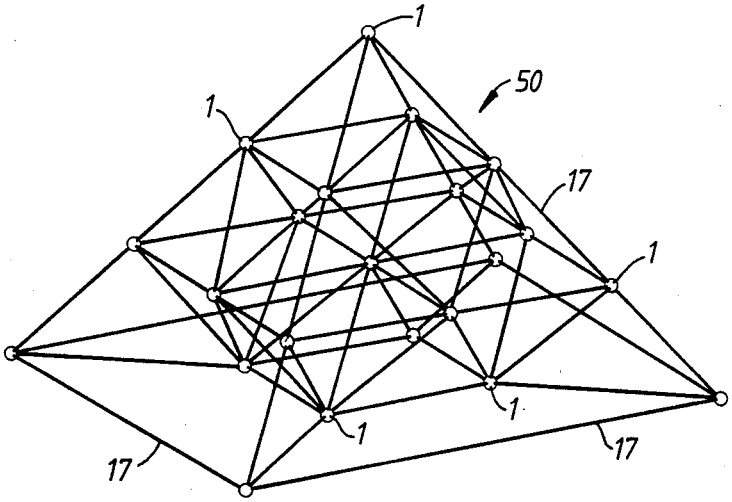
FIG. 3 is a diagrammatic perspective view of a geodesic pyramid made using node members in accordance with the invention.

FIG. 3 shows a climbing frame 50 in the form of a geodesic pyramid made up of node members 1 and connecting members 17 of various lengths.

Figure 4:
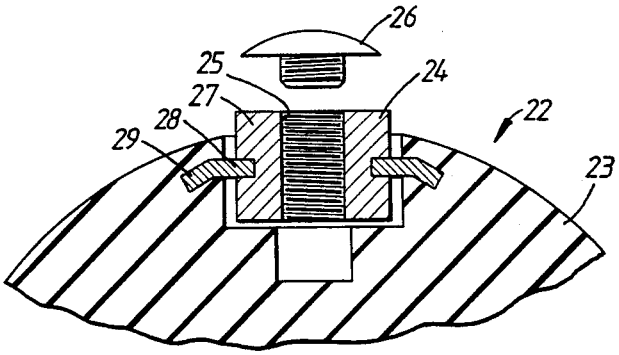
FIG. 4 is a fragmentary sectional view showing another form of node member in accordance with the invention and a screw cap to be used with it.

FIG. 4 shows another form of node member 22 comprising a sphere 23 of moulded rubber material in which are embedded metal connecting means 24 each having a female screw-threaded portion 25 to receive a corresponding male-threaded portion on the end of a connecting member (not shown). A screw-threaded cap 26 is provided to blank off each female screw-threaded portion 25 not required for use in a particular construction. The metal connecting means 24 each comprise a nut 27 rotatably mounted on a washer 28 having lugs 29 embedded in the sphere 23. A spanner may be used to turn the nut 27 to attach a connecting member to it. The number and arrangement of the connecting means may be the same as for the apertures 7 of FIG. 1.

Figure 5:
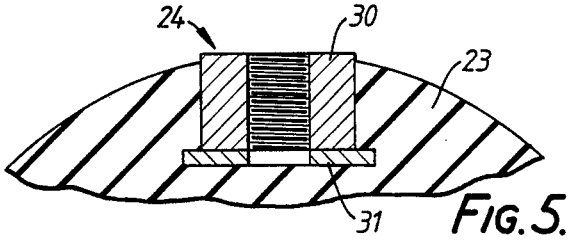
FIGS. 5 to 8 are fragmentary sectional views showing other forms of node member in accordance with the invention.

FIG. 5 shows a modification of the arrangement of FIG. 4 in which the metal connecting means 24 takes the form of a nut 30 embedded in the sphere 23. A washer 31 welded to the inner end of the nut is provided to help retain the nut in the sphere 23. As the nut 30 is not free to rotate relative to the sphere 23, the mating male-threaded portion on the connecting member (not shown) is made rotatable.

Figure 6:
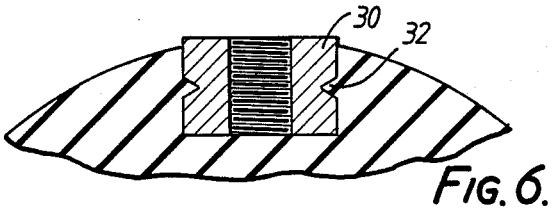

FIG. 6 shows a modification of FIG. 5 in which the nut 30 is given a waist 32 instead of a washer to help retain it in the sphere.

Figure 7:
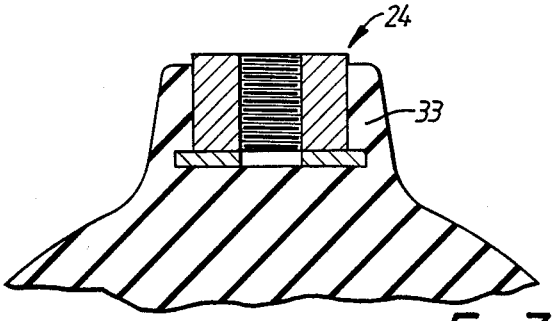
Figure 8:
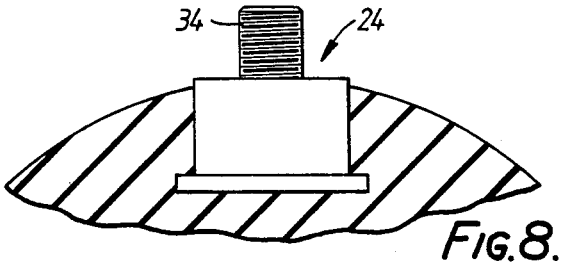

If desired, the metal connecting means 24 may be embedded in neck portions 33 projecting from the moulded rubber sphere as is shown in FIG. 7 to provide greater flexibility. If desired, a male-threaded portion 34 may, as shown in FIG. 8, be provided on the connecting means 24 shown in any of FIGS. 4 to 7 in place of the female-threaded portion, female-threaded portions being provided on the connecting members. In this case, protective screw sockets would be provided for fitting over unused connecting means.

The structures which may be constructed from parts in accordance with the invention are limited virtually only by the imagination of the constructor. Pyramids, domes, and cubic lattices can be constructed as well as structures representing houses, trees with outstretched branches and so forth. The number and orientation of the connecting means in a node member in accordance with the invention is capable of wide variation, for example, tetrahedral, octahedral or cuboctahedral systems of four-fold symmetry can be adopted or dodecahedral, icosahedral or triacontahedral systems of five-fold symmetry.

The number of connecting means provided in a node member in accordance with the invention may be, for example, four or more, eight or more, twelve or more, twenty or more, and in particular just four, just eight, just twelve, just twenty, or just thirty. These number of connecting means can be applied to any of the illustrated node members.

In another form of construction in accordance with the invention, each connecting means can be in the form of a rigid connector, for example, a socket, on a rigid node member body and a separate grommet of resilient material for location between the end of a connecting member and the rigid connector.

We claim:

1. A node member for use in building a geodesic structure, wherein:

said node member comprises a node member body in which a multiplicity of connecting means are mounted in a three-dimensional array about the periphery of the node member body; said connecting means being adapted for connection to other like node members by means of connecting members to form a geodesic structure; and one selected from the group consisting of said node member body and each said connecting means comprises a resilient body of polymeric material co-operating with the other of said node member body and said each said connecting means and adapted to deform resiliently under loading of the geodesic structure to produce substantial relative angular displacement of said connecting members so that said geodesic structure flexes under load, said resilient body providing a restoring force to restore said geodesic structure to its original shape under no load conditions.

2. A node member as claimed in claim 1, wherein said node member comprises a hollow and substantially spherical node member body of substantially rigid material in which connecting means of resilient polymeric material are mounted, the diameter of said node member body being in excess of 100 millimeters, each said connecting means constituting said resilient body to provide said restoring force.

3. A node member as claimed in claim 1, wherein said node member body is hollow and has a multiplicity of apertures in its surface in which the connecting means fit, said connecting means being grommets of resilient polymeric material, each said grommet constituting said resilient body to provide said restoring force.

4. A node member as claimed in claim 3, wherein the apertures are circular and the grommets each have an annular body portion with an annular peripheral groove to engage the edge of an aperture.

5. A node member as claimed in claim 3, wherein each grommet has an extension portion projecting outwardly, in use, from the node member body and including a metal sleeve, bonded to the material of the grommet, to which a connecting member can be secured.

6. The node member as claimed in claim 5, wherein a nut and bolt fixing means retaining said connecting member in said connecting means is provided, said connecting means including a bore receiving said nut and bolt fixing means and running transversely to the longitudinal axis of the sleeve through the extension portion and the sleeve.

7. A node member as claimed in claim 5, in combination with at least one tubular connecting member connectible to the connecting means, wherein the said at least one connecting member has a circular cylindrical end portion adapted to fit within the annular body portion and prevent removal of the grommet from the associated aperture in the node member body.

8. A node member as claimed in claim 7, wherein a nut and bolt fixing means retaining said connecting member in said connecting means is provided, said connecting means including a bore receiving said nut and bolt fixing means and running transversely to the longitudinal axis of the sleeve through the extension portion and the sleeve, said end portion having a pair of aligned apertures to receive the nut and bolt fixing means.

9. A node member in combination with at least one connecting member as claimed in claim 7, wherein at least one connecting member of plate-like form with tubular connecting portions is provided.

10. A node member for use in building a geodesic structure, wherein:

said node member comprises a node member body of substantially rigid material in which a multiplicity of connecting means of resilient polymeric material are mounted in a three-dimensional array about the periphery of the node member body, said connecting means being adapted for connection to other like node members by means of connecting members to form a geodesic structure; and each said connecting means comprises a resilient body of polymeric material for co-operating with the connecting members to deform resiliently under loading of the geodesic structure to produce substantial relative angular displacement of said connecting members so that the geodesic structure flexes under load, said resilient body providing a restoring force to restore the geodesic structure to its original shape under no load conditions.

11. A node member as claimed in claim 10, wherein:

said node member body is hollow and has a multiplicity of apertures in its surface in which the connecting means fit, said connecting means being grommets of resilient polymeric material, each said grommet constituting said resilient body providing said restoring force;

said apertures are circular and the grommets each have an annular body portion with an annular peripheral groove to engage the edge of an aperture; and each grommet has an extension portion projecting outwardly, in use, from the node member body and including a metal sleeve, bonded to the material of the grommet, to which a connecting member can be secured.

12. A node member as claimed in claim 11, wherein a nut and bolt fixing means retaining said connecting member in said connecting means is provided, said connecting means including a bore receiving said nut and bolt fixing means and running transversely to the longitudinal axis of the sleeve through the extension portion and the sleeve.

13. A node member for use in building a geodesic structure, wherein:

said node member comprises a node member body of resilient polymeric material in which a multiplicity of metal connecting means are mounted in a three-dimensional array about the periphery of the node member body, said connecting means being adapted for connection to other like node members by means of connecting members to form a geodesic structure; and said resilient body of polymeric material of each of said node members is adapted to co-operate with the connecting means to deform resiliently under loading of the geodesic structure to produce substantial relative angular displacement of said connecting members so that the geodesic structure flexes under load, said resilient body providing a restoring force to restore the geodesic structure to its original shape under no load conditions.

14. A node member as claimed in claim 13 wherein the metal connecting means are screw-threaded.

15. A climbing frame for use in a children's playground, the frame comprising:

a multiplicity of node members;

each said node member comprising a node member body of substantially rigid material in which a multiplicity of connecting means of resilient polymeric material are mounted in a three-dimensional array about the periphery of the node member body;

a multiplicity of rigid connecting members interconnecting the said connecting means of said node members to form a geodesic structure;

each said connecting means comprising a resilient body of polymeric material co-operating with the connecting members to deform resiliently under the load of a child climbing the frame to produce substantial relative angular displacement of said connecting members so that the frame flexes under the weight of the child, said resilient body providing a restoring force to restore the frame to its original shape under no load conditions.

16. A climbing frame as claimed in claim 15, wherein:

said node member body comprises a hollow and substantially spherical node member body of substantially rigid material in which connecting means of resilient polymeric material are mounted, the diameter of said node member body being in excess of 100 millimeters, said node member having a multiplicity of apertures in its surface in which the connecting means fit, said connecting means being grommets of resilient polymeric material, each said grommet constituting said resilient body providing said restoring forces;

said apertures are circular and the grommets each have an annular body portion with an annular peripheral groove to engage the edge of an aperture; and each grommet has an extension portion projecting outwardly, in use, from the node member body and including a metal sleeve, bonded to the material of the grommet, to which a connecting member can be secured.

17. A climbing frame as claimed in claim 16, wherein said connecting members have a circular cylindrical end portion arranged to fit within the annular body portion and prevent removal of the grommet from the associated aperture in the node member body.

18. A climbing frame as claimed in claim 17, wherein connecting members of tubular form are provided, and at least one connecting member of plate-like form substantially triangular in plan with tubular connecting portions, is provided.

19. A climbing frame for use in a children's playground, the frame comprising:

a multiplicity of node members;

each said node member comprising a node member body of resilient polymeric material in which a multiplicity of metal connecting means are mounted in a three-dimensional array about the periphery of the node member body;

a multiplicity of rigid connecting members interconnecting the said connecting means of said node members to form a geodesic structure;

said body of resilient polymeric material of each of said node members co-operating with said connecting members to deform resiliently under the load of a child climbing the frame to produce substantial relative angular displacement of said connecting members so that the frame flexes under the weight of the child, said resilient body providing a restoring force to restore the frame to its original shape under no load conditions.

20. A climbing frame as claimed in claim 19, wherein the metal connecting means are screw-threaded.

* * * * *